US006365004B1

(12) United States Patent
Hamstrŏm et al.

(10) Patent No.: US 6,365,004 B1
(45) Date of Patent: Apr. 2, 2002

(54) METHOD AND APPARATUS FOR DRYING A PAPER WEB

(75) Inventors: Kristian Hamstrŏm, Turku; Harri Happonen, Tampere; Antti Kuhasalo, Jyväskylä; Juha Lipponen, Palokka; Järkko Nurmi, Turku; Juha Ojanen, Valkeakoski; Hans Sundqvist, Turku, all of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/581,921

(22) PCT Filed: Dec. 4, 1998

(86) PCT No.: PCT/FI98/00945

§ 371 Date: Aug. 17, 2000

§ 102(e) Date: Aug. 17, 2000

(87) PCT Pub. No.: WO99/32714

PCT Pub. Date: Jul. 1, 1999

(30) Foreign Application Priority Data

Dec. 18, 1997 (FI) ..... 974562

(51) Int. Cl.[7] ..... D21F 11/00

(52) U.S. Cl. ..... 162/198; 162/206; 162/207; 162/253; 162/263; 162/359.1; 162/290; 34/452; 34/456; 34/463; 34/117; 34/118

(58) Field of Search ..... 162/198, 206, 162/207, 253, 263, 359.1, 290; 34/452, 456, 463, 453, 454, 460, 464, 117, 118, 123, 114

(56) References Cited

U.S. PATENT DOCUMENTS

| | | | | |
|---|---|---|---|---|
| 3,447,247 A | | 6/1969 | Daane | |
| 3,622,448 A | | 11/1971 | Adams et al. | |
| 4,698,919 A | | 10/1987 | Wedel | |
| 5,438,765 A | | 8/1995 | Tyrmi et al. | |
| 5,845,415 A | | 12/1998 | Sundqvist | |
| 6,128,833 A | * | 10/2000 | Juppi et al. | 34/464 |

FOREIGN PATENT DOCUMENTS

| | | |
|---|---|---|
| WO | WO 97/13031 | 4/1997 |

* cited by examiner

*Primary Examiner*—Stanley S. Silverman
*Assistant Examiner*—Mark Halpern
(74) *Attorney, Agent, or Firm*—Nixon & Vanderhye PC

(57) ABSTRACT

A method and apparatus effect drying of a paper web using a plurality of heated drying cylinders and at least one air impingement module having a hood. The paper web is brought into operative contact with the heated drying cylinders, and at least one of the final moisture content, quality, and cross-direction profile of the paper web is regulated. The regulation is effected by adjusting the efficiency of air impingement drying of the paper web, by adjusting at least one of the blowing velocity of the medium (typically air) blown against the paper web, the humidity of the blowing medium, and the distance of the hood of the impingement module from the paper web. At least one of the final moisture content of the paper web and its quality may also be regulated by adjusting the steam pressure of one or more drying cylinder groups. Typically the final moisture content of the web is measured after the last drying cylinder group and the efficiency of air impingement drying is regulated on the basis of that measurement.

46 Claims, 10 Drawing Sheets

TABLE 1

90 m/s

| AI2 \ AI1 | 250 °C | 300 °C | 350 °C |
|---|---|---|---|
| 250 °C | 87.38% | 88.52% | 89.56% |
| 300 °C | 88.52% | 89.61% | 90.61% |
| 350 °C | 89.58% | 90.63% | 91.57% |

350 °C

| AI2 \ AI1 | 60 m/s | 90 m/s | 120 m/s |
|---|---|---|---|
| 60 m/s | 88.90% | 90.27% | 91.57% |
| 90 m/s | 90.28% | 91.57% | 92.76% |
| 120 m/s | 91.56% | 92.74% | 93.82% |

Fig. 2

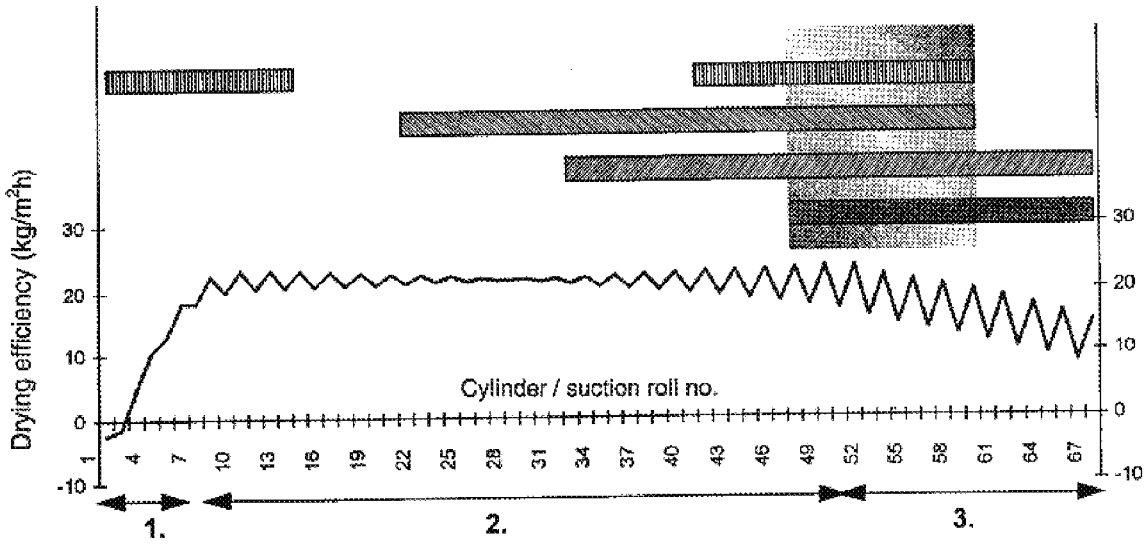
Fig. 8
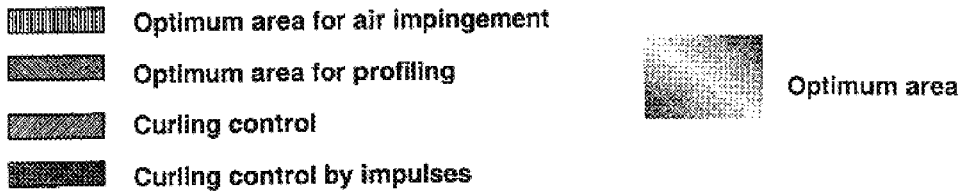

METHOD AND APPARATUS FOR DRYING A PAPER WEB

CROSS-REFERENCE TO RELATED APPLICATION

This application is the U.S. national phase of PCT/FI98/00945, filed Dec. 4, 1998.

BACKGROUND AND SUMMARY OF THE INVENTION

The object of the present invention is a method and apparatus for drying a paper web or the like, as defined in the preambles of the independent claims presented below.

This means that the object of the present invention typically concerns a method and apparatus for drying a paper web or other similar web in the dryer section of a paper machine or the like, in which dryer section the web is dried against the heated cylinder surfaces of the drying cylinders and by means of air impingement drying with at least one air impingement unit.

Another object of the invention concerns the optimisation of paper web drying in the dryer section of a paper machine or the like, the dryer section comprising a drying section consisting of one or more drying cylinder groups and at least one air impingement unit. The invention is, however, intended to be applicable also to other types of dryer sections, if necessary.

It is previously known to use twin-wire web transfer and/or single-wire web transfer in the multicylinder dryers of a paper machine. During the past 15 years, single-wire web transfer has been used to an increasing extent, in which transfer there is only one dryer wire in each drying cylinder group, supported on which wire the web passes through the entire group so that the dryer wire presses the web with the help of the drying cylinders against the heated cylinder surfaces, the web remaining on the side of the outer curve on the turning cylinders or rolls. Thus, in single-wire web transfer, the drying cylinders are outside the wire loop and the turning cylinders or rolls are inside it. Previously known is the type of dryer sections which consist only of so-called normal single-wire web transfer groups in which the drying cylinders are in the top row and the turning cylinders or rolls in the bottom row.

In order to heat up the drying cylinders, steam is introduced inside them and the temperature of the drying cylinders is controlled by regulating the steam pressure and/or the rate of flow of the steam. It is also possible, although rarely implemented, to control the final moisture content reached in the dryer section by regulating the speed of the machine. In such a case the pressure of the steam is kept constant—in machines with limited drying capacity usually at maximum pressure—which means that the final moisture content can be increased or reduced by slowing down or speeding up the passage of the web through the dryer section.

The most commonly used steam pressure regulating systems are so-called cascade regulation and thermocompressor regulation, which are described, for example, in the following publication: TAPPI NOTES, Practical Aspects of Pressing and Drying, Short Course, 1990.

One problem with these conventional-type dryer sections, where drying is carried out entirely by means of drying cylinders, by using either single-wire web transfer or twin-wire web transfer, has related to the regulation of drying efficiency. In order to achieve the desired final moisture content of the web, the drying efficiency of the drying cylinders is generally regulated by regulating the pressure of the steam supplied to the cylinders. This type of regulation is relatively slow and does not, therefore, react at optimum speed, for example, to sudden changes of moisture content in the web originating in the press section or wire section. Particularly in connection with a change of paper grade, start-up and web breaks, final regulation of drying to the optimum level by regulating the pressure of the steam is slow, due to the considerable mass of the drying cylinders. Methods used in regulation have included dry matter measurement based on IR measurement after the last drying cylinder, and feedback for controlling steam pressures, usually to the main steam cylinder group of the dryer section. This type of regulation has, as such, functioned without problems, where it has been a question of standard production at constant speed and no web breaks have occurred. Regulation problems occur, however, in connection with a change of paper grade, web breaks, or the paper machine start-up phase.

In connection with a change of paper grade, problems are caused in conventional dryer sections by the fact that each drying cylinder has a high thermal capacity, due to its great mass, which means that the temperature of the drying cylinders changes slowly. Because of this, the temperature changes in the drying cylinders have not been rapid enough where a change of grade is concerned. In some cases, the changes required relating to the regulation of drying efficiency have been made by changing the loads in the press section, but this will also change the qualities of the paper, which is obviously usually not desirable. Furthermore, when the loads in the press section are changed, the cross-direction profile of the paper web will also change, which means, for example, that there will often be defects in the moisture profile. Due to the foregoing reasons, a web of incorrect final moisture content or quality standard may be reeled on the reel-up in connection with a change of paper grade. According to solutions known from the prior art, it takes some 15–20 minutes after the change of grade before a balanced state is again reached. With paper machine speeds of, for example, 1500–1800 metres per minute, a large amount of paper, that is, paper of incorrect quality, is produced during this time. On a wide machine the amount may be 10–20 tonnes.

During a web break, on the other hand, problems arise, for example, due to the fact that the drying cylinders overheat when no paper that would transfer thermal energy away from the cylinders is supplied to the dryer section. Excessively hot cylinders cause problems in tail threading after a web break, as the tail threading cord adheres to the hot cylinders. In addition, excessively hot cylinders overdry the tail threading cord, which makes the cord brittle and causes it to lose its strength properties, which may cause problems in tail threading. Furthermore, at the stage when the tail threading cord broadens after a web break, it takes a long time before the drying cylinders return to an equilibrium temperature due to the drying cylinders' slow ability to change their temperature, that is, their high thermal capacity. In case of a web break, there was previously no other way of bringing the situation under control than by reducing steam pressures for the duration of the web break. The result of this has in turn been that the final moisture content after a web break has not conformed to the desired values. Furthermore, it has taken a long time before the situation could be returned to correspond to normal running conditions.

At the paper machine start-up stage, the steam pressures suitable for a particular paper grade are usually first taken from a memory in which adjustment values that have proved good in earlier, corresponding running situations have been collected, for example, in tables, and the steam pressures in the drying cylinders are controlled by means of the above data. The steam pressures selected and their time staggering, or change, may also be based on computational models and values obtained thereby. Conventionally, when the web is first taken to the machine, the steam pressures used are slightly below the optimal pressures, and after this the steam pressures are increased to the desired level. The high thermal capacity due to the great mass of the drying cylinders makes start-up slow, so that it takes a long time before the desired situation is reached. This is problematic because during the start-up stage a large amount of paper of an incorrect type is produced.

The problems described above are thus mainly due to the fact that the thermal capacity of the drying cylinders is high and there is a long time-lag before they achieve the temperature changes required.

The dryer section is the part of the paper machine that uses the most energy. It can be said that as much as over two thirds of the energy consumption of a paper machine takes place in the dryer section. The dryer section should, therefore, be used as economically as possible, that is, in such a way as to achieve as high an evaporation efficiency as possible, and a high-quality drying result and low energy consumption. Drying must be uniform also in the cross direction of the web. Cylinder drying is currently the most common drying method used.

The web cannot be profiled, that is, evaporation cannot be regulated so as to be uniform in the cross direction of the web by means of regulating the steam pressure of the cylinders or the speed of the machine. In the dryer section, or even before it, streaks often form at some points on the web parallel to the travel direction of the web, in which the web dries more than at other points. Variations in the moisture profile of the web to be dried when it arrives at the air impingement unit are not only dependent on non-uniform drying in the actual dryer section, but are often due to non-uniform dewatering in the press section. Variations in the moisture profile may also be due to a non-uniform solid matter profile appearing already on the wire section. Changes in the need for drying also arise in connection with a change of grade. Moisture profile defects such as these must be rectified.

Previously, attempts have been made to rectify moisture profile defects by spraying water jets directed from jet pipes or nozzles fitted across the web at the said areas in order to render the web moisture level uniform. Adding water to the web is obviously less advantageous from the point of view of energy consumption, because the water sprayed for the purpose of regulation must be evaporated again from the web at a later stage. An alternative way of rectifying a moisture profile defect has been to use infrared dryers fitted across the web, which will evaporate water especially from the areas of the web with the highest moisture content. Infrared dryers consume relatively large amounts of energy.

In cylinder drying, the web to be dried is passed over the surface of the drying cylinder, pressed by the wire, which means that the side which is against the web cylinder at any time heats up and dries more efficiently than the other side of the web. In modern, fast machines, in which the web is dried using single-wire web transfer, only one and the same side of the web comes into contact with the cylinder surface in each dryer group, and thus dries more efficiently than the other side of the web. One-sided drying of the paper web is even further emphasised if the paper web is passed to the drying cylinders with the same side always in contact with them, also in the different drying cylinder groups. Paper dried in this one-sided manner tends to curl when in the form of sheets, which causes major problems in the finishing of the paper.

To solve the foregoing problem of one-sidedness, that is, curling, it has been suggested that a so-called reversed group be fitted in the dryer section, through which the web is passed supported on the wire so that the other, less efficiently dried side, will run in contact with the drying cylinders. This solution requires a different type of dryer section construction in which, deviating from other dryer groups, the drying cylinder and wire loop are fitted to run below the web. In this case, the paper broke formed during a web break or start-up falls down into the pockets formed by the wire loop, between the drying cylinders and the wire, from where it may be difficult to remove the broke. Due to the difficulties relating to the removal of broke, the runnability of this type of a reversed dryer section is poor in connection with web breaks and start-ups. In conventional single-wire web transfer, on the other hand, the wire loop is fitted to run above the web, in which case the broke formed in connection with a web break falls freely below the machine, from where it can easily be removed.

The aim of the present invention is in fact to achieve an improvement to the problems described above.

It is a particular aim of the invention to create a method and dryer section, in which rapid regulation of drying efficiency is possible, for example, in connection with a change of paper grade, web breaks and start-up situations.

Another aim is to achieve an energy-efficient method and apparatus which make possible rapid adjustment of overall evaporation, for example, in connection with a change of paper grade, a web break and start-up.

A further aim is to achieve a method and apparatus which make possible precisely targeted adjustment of evaporation, such as adjustment of profiling or evaporation also in the cross direction of the web.

Yet another aim is to achieve a method and apparatus, by means of which one-sided drying of the web and the consequent curling can be minimised.

Yet another aim is to achieve the type of method and apparatus for regulating the drying of a paper web which allows easy maintenance of the dryer section, rapid removal of broke and thus good runnability.

In order to achieve the above-mentioned aims, the method and apparatus relating to the invention are characterised by what is specified in the characterising parts of the independent claims presented below.

Instead of a dryer section based on conventional drying cylinder drying, the invention relates to a dryer section which applies both air impingement drying and drying by means of drying cylinders. As regards this type of dryer section, reference is made, for example, to the applicant's Finnish patent applications FI 971713 and FI 971714.

In this application, air impingement drying refers both to air impingement drying, directed directly to the web, and to through-flow drying, being effected through the wire or a corresponding conveyor fabric. So-called through-flow drying, which is particularly well-suited for drying porous webs, is also included within the scope of the air impingement drying referred to in the invention. According to the invention, air impingement drying can be directed at a web passing over a large-diameter cylinder, roll, suction roll, through-flow cylinder or other curved surface. Air impingement drying can also be directed linearly, for example, to a web supported by a wire or belt which runs supported on rolls or blow boxes. The linearly running web may be arranged to run in a horizontal, vertical or inclined position. Hot air or superheated steam are preferably used as the medium in air impingement.

In order to achieve the aims presented in the foregoing and appearing later, a typical method relating to the invention for drying a paper web or the like in a dryer section comprising at least one air impingement unit, is characterised mainly in that, according to this method, the final moisture content of the paper web and/or any other machine-direction quality and/or the cross-direction profile are adjusted by regulating the efficiency of air impingement.

The apparatus relating to the invention for drying a paper web or the like in a dryer section comprising at least one air impingement unit is mainly characterised in that it incorporates a measuring instrument for measuring the final moisture content of the paper web and/or other machine-direction quality and/or the cross-direction profile, and means for regulating the blowing force of at least one air impingement unit on the basis of the measurement result.

According to the invention, air impingement drying can be used during different transient stages, such as those concerning a change of grade, a web break and start-up, for controlling changes in drying capacity, and for eliminating or at least minimising the problems occurring during these stages.

The advantages achieved by means of the invention are based especially on the fact that air impingement reacts extremely rapidly to adjustment measures, which means that it can be used for the rapid adjustment of drying efficiency required by, for example, a change of grade, a web break or start-up. In addition to the rapid adjustment of drying efficiency, the steam pressures of the drying cylinders in the dryer section are advantageously also regulated at the same time.

In the regulation of the drying efficiency of the dryer section and drying method relating to the invention, an optimisation algorithm known as such, may be used, which algorithm optimises the drying costs and/or qualities of the paper. According to the invention, for example, MPC (Model Predictive Control), that is, model predictive multivariable control can also be used.

When air impingement is used in accordance with the invention for regulating drying efficiency, one or more of the various air impingement parameters can optionally be adjusted as desired in the air impingement: for example, the blowing rate, the temperature of the blowing medium, the humidity of the blowing medium, and the distance of the air hood from the web (advantageous especially during web breaks). The air impingement hoods can also be built of machine-direction segments, in which case it will be possible to adjust and/or, where necessary, to close each segment separately. In order to adjust the cross-direction profile, the air impingement hoods can also be divided into cross-machine direction segments in which the above-mentioned air impingement parameters can be adjusted either together or separately.

In connection with a change of grade, the set values required by the new paper grade are usually known in advance, that is, for example, the steam pressures of the drying cylinders by means of which the desired end product is achieved. The steam pressure may thus be set at the desired level immediately at the start of the change of grade or gradually, also when applying the method relating to the invention. However, since this type of adjustment is slow, air impingement is regulated at the same time according to the invention, either on the basis of an existing air impingement model, by means of which the required regulation measures are calculated, or through continuous feedback regulation. As the drying efficiency of the cylinders gradually changes, the change is compensated by an opposite change in the drying efficiency of the air impingement.

At the stage of starting up a paper machine, the drying cylinders are first heated in accordance with known heating sequences. The air impingement hoods are preheated in a corresponding manner. After this, the running parameters may be set as desired in accordance with the predetermined values or the drying simulation calculation. By means of feedback, the values of the drying cylinders and air impingement can then be controlled so that the desired quality parameters are obtained.

When the running of a completely new paper grade is begun, the set values that have proved good for the closest paper grade among previous running situations are first selected from the memory, and after this, by utilising these set values and by applying feedback, air impingement and advantageously also steam pressures are regulated so that the desired values are obtained for the new paper grade.

In case of a web break, the steam pressures of the drying cylinders are dropped, the air impingement hoods are opened and the broke is directed for removal by means of the broke conveyors. The hoods' own control system takes care of by-pass air circulation inside the hood, gas feed regulation, and regulation of the blowing rate, exhaust air and fresh air. When the track is restarted after tail threading, these measures are obviously carried out in reverse order and the required regulation of drying efficiency is carried out by means of air impingement.

The invention is naturally also applied in regulating drying efficiency during normal running, in addition to the special stages described above. According to the invention, the quality of the paper can be optimised continuously, also in the quality sense, while at the same time applying the cost data. This means that the position of the air impingement unit relating to the invention in the dryer section may also become a regulating parameter.

The position of air impingement has been taken into account in one particular embodiment of the invention, in which the dry matter content of a paper web coming from the press section of the paper machine and guided through at least one drying cylinder group, and dried to a dry matter content of preferably, for example, over 70%, even over 75%, is regulated by passing the paper web, supported on the wire or the like, through a slot-like space formed between

- a curved or linear air impingement hood extending across one or more webs, and
- a curved or linear surface, such as a cylinder, roll or vacuum box extending across one or more webs, and
- by blowing towards the paper web, from the said one or more air impingement hoods in the said slot-like space, several successive hot air jets of predetermined drying efficiency and in cross direction to the web. If so desired, steam jets can be used instead of air jets, in which case, however, consideration must be given to the special demands made by hot steam on the hood construction of the hood as well as, for example, its sealing requirements.

The air impingement hood refers to any box-like construction known as such, from which hot air or steam jets are blown through holes, slots or other nozzles onto the web.

The vacuum box refers advantageously to a box-like construction creating a low vacuum of approximately 100–400 Pa, preferably 200–300 Pa, between the vacuum box and the wire/web, the side of the construction on the web's side being mainly planar. The purpose of this relatively low vacuum is to prevent the detrimental detachment of the web from the wire. The aim is, by means of the vacuum, to prevent, the web from flapping, for example, due to the blowing from above, and thus coming into contact with the air impingement hood. The aim is to guide the web in a controlled manner through the slot formed between the boxes. The low vacuum required can preferably be created by means of a blow box, such as the one described in FIG. 4*a* below, or by means of a suction box.

A typical paper machine dryer section can be divided into three parts:

- a first part, in which the paper web is primarily heated, however, at the same time increasing the dry matter content of the web typically within the range of 40–60%,
- a second part, in which most of the free water in the web is removed through uniform evaporation in the drying cylinder groups through which the web is passed as single-wire or twin-wire web transfer, and in which the dry matter content of the web increases typically within the range of 45–85%, and
- a third part, in which the web is finally dried by means of the drying cylinders, and in which the dry matter content of the web typically increases to a range of 75–98%.

In a special embodiment of the invention, the air impingement unit which enables the precisely targeted adjustment of drying can be fitted in the optimum area in the dryer section with a view to the regulation of drying and energy consumption, that is, for example, in an area where the web has already reached a dry matter content of >70%, preferably 75%. The said area is located at the end of the dryer section, typically before the last or second last drying cylinder group, a typical drying cylinder group in a dryer section provided with single-wire web transfer comprising approximately 3–8 drying cylinders.

The relative drying efficiency of the drying cylinders falls once the web has reached a dry matter content exceeding 70%, typically 75%, that is, when the major part of the readily evaporated water has been removed from the web. By means of air impingement, water bound more closely in the web can be removed, even from a web as dry as this, with good drying efficiency.

In the solution relating to the special embodiment of the invention, the new observation is utilised that by means of air impingement, as an efficient drying impulse,

- it is possible to influence web drying advantageously, not only at the initial stages of drying, that is, while raising the temperature of the web, but expressly also at the final stages of drying. The use of the drying cylinders is most effective, from the energy efficiency perspective, more or less at the middle of the dryer section;
- it is possible to influence the profiling of the web when the dry matter content of the web is more than 70%, even more than 90%, until the final dry matter content is reached. With previously known methods, attempts have been made to influence the profiling of the paper web at the end of the dryer section.
- it is possible to eliminate the curling of paper in a preferred manner at the final stage in the dryer section, where the dry matter content of the web is already over 70%, typically over 75%, in an area after which the paper web no longer tends to dry one-sidedly as readily as in the middle of the dryer section. The use of reversed groups at the end of the dryer section has previously been suggested for the control of curling.

It has now been found that the optimum area for the combined raising of drying efficiency, profiling and curling control by means of air impingement is located at the end part of the dryer section, where the dry matter content of the paper web is more than 70%, preferably more than 75%, up to a dry matter content of about 95%, preferably within the range of 75%–85%. Even a very short, effective drying impulse lasting less than 1 second, or even less than 0.5 second, is often sufficient for regulating drying. A short, efficient drying impulse can be achieved by linear air impingement, over a length of 1–20 m, preferably 5–10 m.

Generally, it may be advantageous to carry out final drying after air impingement by means of drying cylinders, with one or two drying cylinder groups. In certain special cases, the air impingement unit relating to the invention can also be fitted at the very end of the dryer section. This should be done especially when the final dry matter content of the web being dried remains at 90% or only slightly above this.

The regulation of drying efficiency is usually based on the dry matter content of the web measured after the dryer section, irrespective of the cause of the need for a change in drying. Measurement may obviously also take place elsewhere, before or after the air impingement unit. The drying efficiency of the air impingement unit relating to the invention is also adjusted on the basis of the dry matter content measured. The drying efficiency of a typical air impingement unit relating to the invention is regulated by adjusting the temperature, moisture content or velocity of the air jets blown.

The blast air used in the air impingement unit is preferably blast air conducted from the paper machine room, or in a dryer section closed by a hood, the return air of the hood, or the air impingement device's own return air. The temperature of the blast air is raised and/or its humidity level is lowered before blowing towards the paper web. The return air of the various air impingement units can be heated by means of a common burner, such as a gas or oil burner or other similar heater fitted in a separate space adjacent to the dryer section. On the other hand, an individual burner or the like may be integrated into each air impingement unit or part of a unit, in the web direction or in the cross direction of the web, which means that the different air impingement units or their parts can be adjusted independently of each other.

The air impingement hood or unit relating to the invention preferably blows hot air, the temperature of which is set between 40° C.–500° C., advantageously 200° C.–400° C., depending on the drying efficiency required at any time. The moisture content of the air jets typically varies between 0–300 g $H_2O$/kg of dry air.

The drying efficiency of the air impingement unit can, however, also be regulated by adjusting the velocity of the air jets. In such a case the velocities of the air jets are typically maintained between 40–200 m/s, preferably between 50–150 m/s, and most preferably between 70–120 m/s.

By means of the efficient hot air or steam jet of the air impingement system relating to the invention, it is possible to regulate drying directed at the paper web extremely rapidly, practically without delay. The change of adjustment taking place in the air impingement hood is seen to its full extent in the paper web within a few seconds.

The temperature of the hot air can be regulated simply by adjusting the fuel valve of the burner. No time is taken for raising or lowering the temperature of the device itself, as in drying with a drying cylinder. By means of air impingement according to the invention, drying efficiency can be changed by 20–100% extremely rapidly. A complete change can typically be achieved in less than 30 seconds, usually in less than 10 seconds, which is only a fraction of the time required for bringing about the same change with conventional cylinder drying. Regulation by cylinder drying takes several minutes.

In the dryer section, two air impingement units can also be fitted in succession within the optimum range for regulating air impingement, in which case their drying efficiency can be adjusted either separately or together in order to achieve an optimal drying result. It is usually advantageous to fit successive air impingement hoods in the dryer section in such a way that the drying efficiency of the air jets coming from the first air impingement hood is on average greater than the drying efficiency of the air jets coming from the air impingement hood following it.

Each air impingement unit relating to the invention preferably comprises several adjacent rows of nozzles which are formed by blow nozzles fitted in succession across the web. These nozzles can be arranged so as to be adjustable all by the same adjustment, each nozzle separately, or a specified group of nozzles separately. It is often advantageous to divide the air impingement unit relating to the invention into several segments in the cross direction of the web, in which case the nozzles in the different segments can be adjusted separately. The segments may be as narrow as 100 mm. Typically, the width of the segments varies between 500 mm–2000 mm.

BRIEF DESCRIPTION OF THE DRAWINGS

The invention is described in greater detail in the following, with reference to the appended drawings, to the details of which the invention is not intended to be strictly limited in any way, and in which FIGS. 1*a*/1*b* show a diagrammatic view and an example of a dryer section in a paper machine in which the method relating to the invention is used for adjusting the drying cylinders and regulating air impingement;

FIG. 2 shows a table which shows, as an example, the effect of the blowing temperature and blowing velocity of air impingement on drying capacity;

FIG. 8 shows a typical drying efficiency curve of the drying cylinders in a dryer section provided with single-wire-wire web transfer.

DETAILED DESCRIPTION OF THE DRAWINGS

Figure 1A:
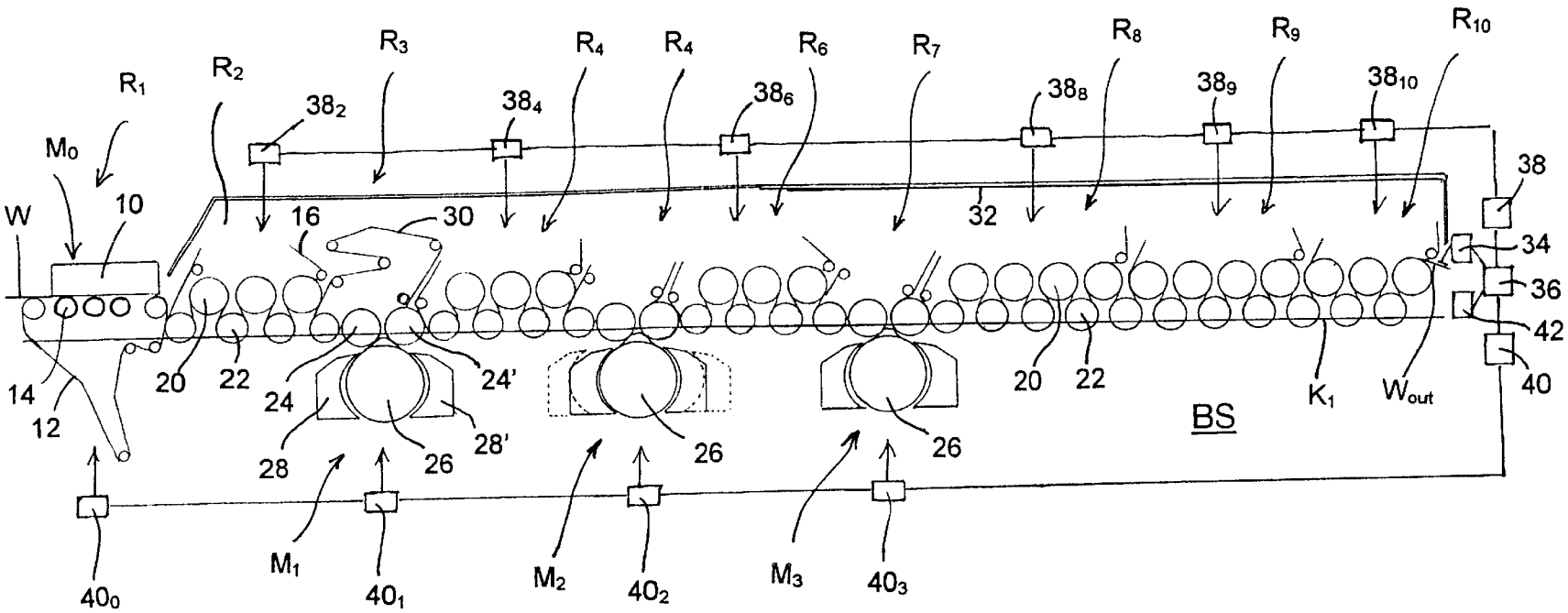

In FIG. 1*a*, the invention is described in conjunction with the first dryer section, that is, the dryer section fitted immediately after the press section. This is not, however, intended in any way to limit the invention to concern only the first dryer section. The invention is fully applicable also to the intermediate dryer section or last dryer section. In the present specification and claims, the term dryer section in fact refers to the dryer section as a whole and its parts, such as the first, intermediate and last dryer sections, unless otherwise specified.

FIG. 1*a* shows a particularly advantageous dryer section solution in which the invention is applied. In FIG. 1*a* the paper web W is conveyed from the press section (not shown) of the paper machine to the beginning of the dryer section, to its first dryer unit $R_1$ by means of the press felt. In the case of FIG. 1*a* the first dryer unit is a planar dryer unit, that is, the linear air impingement unit $M_0$, which comprises an air impingement hood 10, from which hot air and/or steam is blown onto the web W running on the wire 12. The web runs below the hood 10 on the horizontal run of the wire 12, which is supported on support means 14. The said means supporting the horizontal run of the wire 12 and thus also the web, consist, for example, of grooved rolls and/or suction or blow boxes. By means of the air impingement module $M_0$ of the dryer unit $R_1$, an intensive drying energy impulse is directed at the web W from the air hood.

In the air impingement module $M_0$, the paper web runs linearly on the horizontal plane, supported by the upper run of the dryer wire 12, in such a way that it is not subjected to any great changes of direction and thus no great dynamic forces are exerted on it, which might cause a web break in the web, which is still relatively moist and thus fragile. Inside the air hood 10 is a nozzle arrangement for the purpose of bringing about air impingement, by means of which arrangement hot drying gases such as air or steam are blown onto the upper surface of the web. In the dryer unit $R_1$ it is possible, additionally or alternatively to employ radiators such as infrared heaters. The air impingement devices and/or radiators of the dryer unit $R_1$ can be arranged so as to be adjustable as to their efficiency in the cross direction of the web, for the purpose of achieving cross-web profiling in the web W. Although the air impingement module $M_0$ shown in FIG. 1*a* is a horizontal model, it is obvious that in its place, alternatively or in addition, other types of units may also be used, such as a drying device based on air impingement taking place above the suction roll. At this point, the air impingement module $M_0$ can even be replaced by a cylinder group, if air impingement drying can be utilised in accordance with the invention at a later stage in the dryer section. In the planar dryer unit $M_0$, an impermeable belt can be used instead of a conventional wire 12.

In FIG. 1*a* the first so-called normal (non-reversed) dryer unit $R_2$, comprising a single-wire-wire 16 drying cylinder group, is fitted after the planar dryer unit $M_0$. The wire 16, like most of the other wires, is shown only partly in the figure. The second dryer unit $R_2$, as well as the next similar, so-called normal, downwards-open dryer units $R_4$, $R_6$, $R_8$, $R_9$ and $R_{10}$ comprised of a single-wire cylinder group, incorporate three or four contact drying cylinders 20 fitted in the top row and heated by means of steam, and three or four turning suction rolls 22, for example a VAC-roll, fitted on the bottom row. The paper web W to be dried comes into direct contact with the surfaces of the drying cylinders 20 heated with steam. On the turning suction rolls 22, the web W remains on the side of the outer curve of the dryer wire 16.

In the dryer section shown in FIG. 1*a*, the dryer unit $R_2$ is followed by an air impingement dryer unit $R_3$, which comprises two contact drying cylinders 24, 24', and an air impingement module $M_1$, which in turn comprises a large-diametral $D_1$ air impingement/through-flow cylinder 26 with bores in its envelope, subsequently called a large-diameter cylinder, and openable hoods 28, 28' partly covering the envelope of the said large-diameter cylinder 26. A dryer wire 30 is fitted to pass around the contact drying cylinders 24, 24' and the large-diameter cylinder 26.

The air impingement module $M_1$ of the drying cylinder $R_3$ is fitted in the basement premises BP below the floor level $K_1$ of the paper machine room, and mounted on the floor level of the said space. The central shafts of the contact drying cylinders 24, 24' of the air impingement dryer unit $R_3$ and the similar following air impingement dryer units $R_5$ and $R_7$ relating to the invention are preferably located substantially at the floor level $K_1$ of the paper machine room, or close to it, most preferably slightly above it.

The paper web W to be dried is passed from the dryer unit $R_2$ comprised of the first drying cylinder group, preferably as a closed transfer, to the first contact drying cylinder 24 of the next air impingement dryer unit $R_3$, after which the web W is passed on the wire 30 of the unit $R_3$ over the large-diameter cylinder 26 of the air impingement module $M_1$, in a considerably wide sector b≈180°–280°, supported by the dryer wire 30, and from there on to the second contact drying cylinder 24' of the said unit $R_3$. From this second cylinder 24', the web W is transferred, again preferably by a closed transfer, to the next so-called normal dryer unit $R_4$ comprised of a drying cylinder group, which unit is basically similar to the dryer unit $R_2$ described above. After this follows another air impingement dryer unit $R_5$ equipped with a large-diameter cylinder, the said unit being similar to the air impingement dryer unit $R_3$ described above, and the large-diameter cylinder 26 of which is also located in the basement premises BP. After the dryer unit $R_5$, the web W is conveyed, still preferably by a closed transfer, to the next dryer unit $R_6$ comprised of a drying cylinder group, the said unit being similar to the dryer units $R_2$ and $R_4$. After the dryer unit $R_6$ follows the third air impingement dryer unit $R_7$ equipped with a large-diameter cylinder, the large-diameter cylinder 26 being also located in the basement premises BP. After the air impingement dryer unit $R_7$ follow three successive so-called normal dryer units $R_8$, $R_9$ and $R_{10}$, comprised of drying cylinder groups, each incorporating three or four drying cylinders 20. From the last dryer unit $R_{10}$ the web $W_{out}$ is fed out of the dryer section to the reel-up or finishing unit (not shown).

Both the so-called normal dryer units $R_2$, $R_4$, $R_6$, $R_8$, $R_9$ and $R_{10}$, and the air impingement dryer units $R_3$, $R_5$ and $R_7$ open downwards, which means that paper broke is easily removed from them, on the broke conveyor below the units, or to the pulper below. Beneath the air impingement modules $M_0$, $M_1$, $M_2$ and $M_3$, in the basement premises BP, or even beneath these premises, there is ample space for various kinds of equipment such as ducts, through which the heating medium, such as heated air or steam is introduced, for example, into the hoods 28, 28' of the modules $M_1$, $M_2$ and $M_3$. Above the dryer units $R_2$–$R_{10}$ there is a ventilated dryer section hood 32, known as such.

Figure 1B:
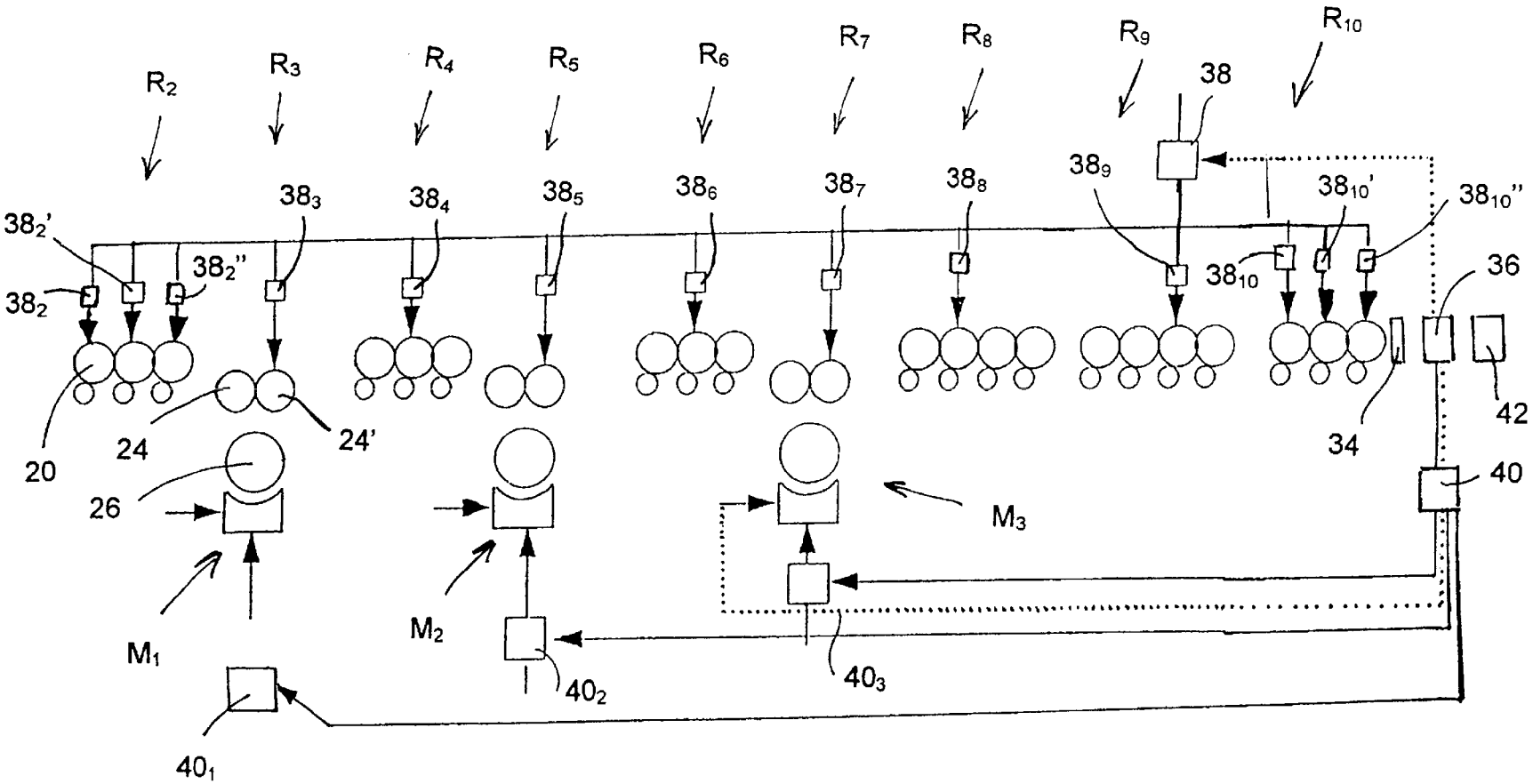

The method of regulation relating to the invention is described in the following with reference to FIGS. 1*a* and 1*b*. FIG. 1*b* shows a simplified representation of the control circuits of FIG. 1*a*. FIG. 1*b* omits the first dryer unit $R_1$ of the dryer section, that is, the planar air impingement module $M_0$, but it can be employed in the same manner as the air impingement modules $M_1$, $M_2$, $M_3$ for the rapid regulation of drying efficiency required by the dryer section in a manner described in the following. In FIG. 1*b*, the same reference numbers are used for corresponding parts as in FIG. 1*a*.

A measuring device 34 is located after the last dryer unit $R_{10}$ of the dryer section, which measuring device measures the moisture content of the paper web W. If so desired, regulation may obviously also be based on the measurement of other quality parameters of the paper web, such as web brightness, or on cross-direction profile measurements of the paper web W. From the measuring device 34, the measurement results are fed through the control unit 36 to the steam pressure control 38 of the drying cylinders 20, 24, 24', and to the air impingement control unit 40, by means of which the drying of the paper web W is controlled in such a way that the rapid action required by drying in connection, for example, with a web break, a change of grade and the start-up stage are carried out by means of the air impingement modules $M_0$, $M_1$, $M_2$, $M_3$ of the air impingement units, while the steam pressure control unit 38 ensures that the steam pressures of the drying cylinders 20, 24, 24' are adjusted to the desired level.

According to the invention, the air impingement control unit 40 can be used to control the air impingement parameters of the air impingement modules $M_0$, $M_1$, $M_2$, $M_3$, such as the temperature, velocity or humidity of the blast air/steam, or the distance of the hood from the web, either in one of the modules $M_0$, $M_1$, $M_2$, $M_3$ at a time, or in several modules simultaneously. In the case shown in FIGS. 1*a* and 1*b*, each of the air impingement modules $M_0$, $M_1$, $M_2$, $M_3$ has its own control unit $\mathbf{40}_1$, $\mathbf{40}_1$, $\mathbf{40}_2$, $\mathbf{40}_3$ for transmitting their control parameters. When rapid action is required for regulating drying efficiency, either one or several of the air impingement modules $M_0$, $M_1$, $M_2$, $M_3$ are controlled so that the desired moisture content and other properties of the paper are obtained rapidly. In the air impingement modules $M_0$, $M_1$, $M_2$, $M_3$, one or more of the following controlled variables can be controlled at the same time to achieve the desired regulatory action: blowing velocity, temperature of the blast air, humidity of the blast air and/or distance of the air hood from the web W. Any air hood or its segment may, on the other hand, be switched off completely if desired.

On the other hand, by means of the steam pressure control 38 of the drying cylinders it is possible to control the steam pressures of the conventional drying cylinders 20 or the contact drying cylinders 24, 24' of each dryer unit $R_2$, $R_3$, $R_4$, $R_5$, $R_6$, $R_7$, $R_8$, $R_9$, either by controlling the steam pressures of one or more drying cylinders or contact drying cylinders separately, or by controlling the steam pressures of one or more cylinder groups separately by means of regulating elements $\mathbf{38}_2$, $\mathbf{38}_2'$, $\mathbf{38}_2''$, $\mathbf{38}_3$, $\mathbf{38}_4$, $\mathbf{38}_5$, $\mathbf{38}_6$, $\mathbf{38}_7$, $\mathbf{38}_8$, $\mathbf{38}_9$, $\mathbf{38}_{10}$, $\mathbf{38}_{10}'$, $\mathbf{38}_{10}''$, on the basis of the control signals transmitted. Control of the steam pressures of several dryer groups simultaneously also falls within the scope of the invention, because often, for example for reasons of cost, there are fewer steam groups than wire groups.

During normal operation, drying and/or any other quality parameter can be kept within the desired limits by adjusting, for example, only one or two of the air impingement modules $M_0$, $M_1$, $M_2$, $M_3$. One or more of the blasting parameters of these modules or the distance of the air hood from the web W are controlled on the basis of the measurement results obtained from final moisture content measurement 34 in such a way that the desired final moisture content or quality properties are obtained. If necessary, the final moisture content or other quality parameter may also be corrected by regulating the steam pressure of one or more cylinders 20, 24, 24' or cylinder groups of the drying cylinder units $R_2 \ldots R_{10}$, through use of steam pressure control 38.

The blasting parameters are controlled in the air impingement control units 40, $\mathbf{40_0}$, $\mathbf{40_1}$, $\mathbf{40_2}$, $\mathbf{40_3}$, either on the basis of an optimisation algorithm or by utilising multivariable control. If necessary, both air impingement and the steam pressures of the drying cylinders can be controlled simultaneously in order to achieve the desired quality parameters.

When the paper grade is changed, the information on the desired grade is taken to the control system 36 from the memory 42, for example from a table, and on the basis of this information on the grade, the steam pressures of the cylinders 20, 24, 24' of the selected drying cylinder groups $R_2 \ldots R_{10}$ are controlled by the control unit 38, by means of the tabular values and a calculation formula, for example in such a way that the steam pressures are regulated gradually to the desired level. The rapid regulation required by the change of grade is effected at the same time, in order to obtain paper possessing the desired qualities as rapidly as possible, by means of air impingement control 40, either by controlling air impingement on the basis of a target value by calculating the required blasting parameters, or by continuous feedback control from measurement point 34.

At the start-up stage, the drying cylinders 20, 24, 24' are first heated according to known heating sequence parameters, and at the same time the preheating of the hoods 10, 28, 28' of the air impingement modules $M_0$, $M_1$, $M_2$, $M_3$ is carried out. After this, the running parameters are set on the basis of the predetermined values, and air impingement is controlled by means of the feedback control feature, in order to obtain the desired quality rapidly, after which air impingement continues to be regulated while the steam pressures of the cylinders change, until they have reached the target values.

During a web break, the necessary adjustments are carried out, that is, the steam pressures of the drying cylinders 20, 24, 24' are adjusted to the break steam settings applied during a web break, and air impingement modules $M_0$, $M_1$, $M_2$, $M_3$ are switched on at the same time on the basis of machine automation control. The internal control systems $\mathbf{40_0} \ldots \mathbf{40_3}$ take care of by-pass circulation inside the hood, reducing gas feed, and reducing blowing velocity and closing off exhaust air and opening up fresh air feed. After the break, the above-mentioned measures are carried out in reverse order, and rapid quality correction is carried out by adjusting the air impingement parameters, until the drying cylinders 20, 24, 24' reach the desired target values.

When a new paper grade is to be run, the parameters of the paper grade most similar to the new grade are selected from the memory 42, for example from a table therein, and the air impingement modules $M_0$, $M_1$, $M_2$, $M_3$ and the steam pressures of the drying cylinders 20, 24, 24' are adjusted on the basis of these. By means of feedback control, the quality parameters are then adjusted so as to obtain paper possessing the desired properties.

Also when regulating the moisture content, tension or other quality profiles of a paper or board web in different operational situations, it is advantageous to do so in accordance with the invention. It is worthwhile to carry out at least rapid corrections of the cross-direction profile by regulating the efficiency of air impingement in the cross direction. The corrections made can then in the long term be carried out by means of other profiling devices, should this, for example, be more cost-efficient.

Table 1 shows the effect of the blowing temperature and blowing velocity of the air impingement module $M_1$, $M_2$, $M_3$ on drying capacity. The table is based on the results obtained by means of a dryer section simulation programme verified by measurement results, in a case where the air impingement of one or two modules $M_1$, $M_2$, $M_3$ relating to FIG. 1*a* is being regulated. In the table, the air impingement modules are marked with reference markings AI1 and AI2. In the simulation programme, the speed of the paper machine was assumed to be 2000 m/min and the width of the paper web 9.5 m and the grammage of the paper web 41.4 $g/m^2$. The first part of the table shows, as marked above the table, the effect of regulation of blast air temperature on drying, when the air impingement velocity is 90 m/s. The second part of the table shows, in a corresponding manner, the effect of regulation of air impingement velocity on drying, when the blast air temperature is 350° C. In the table it can be observed, for example, that by means of one air impingement unit, at a blowing velocity level of 90 m/s, a moisture content correction of the magnitude of about 2 percentage points can be achieved by varying the temperature of the blast air between 250° C.–350° C. Similarly, by increasing the blowing velocity from 60 m/s to 120 m/s, a change of about 2.5 percentage points is obtained with one, and of 5 percentage points with two air impingement units.

In applying the invention, the drying efficiency can thus be increased and the cross-direction profile adjusted by installing air impingement units blowing hot air or hot/superheated steam in the dryer section, in conjunction with the cylinders, rolls or planar wire runs therein. In the following, FIGS. 3*a*–3*d* show some air impingement modules differing from the preferred air impingement modules $M_1$–$M_3$ for applying the invention shown in FIG. 1*a*.

Figure 3A:
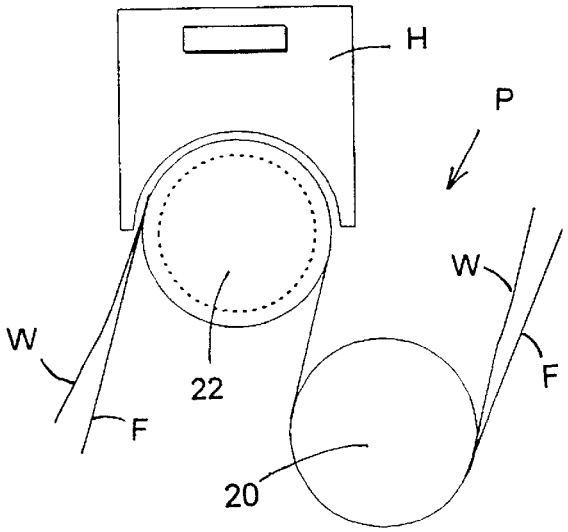
FIGS. 3*a*–3*d* show diagrammatically previously known air impingement units fitted in conjunction with drying cylinders or suction rolls.

FIG. 3*a* shows an air impingement concept in which, in a reversed dryer section, a curved air impingement hood H, conforming to the surface contour of the suction roll 22 preceding the drying cylinder 20, is fitted over the suction roll. The hot air jets of the air impingement hood, which are not shown in greater detail, are directed onto that side of the paper web which is against the hot cylinder surface on a drying cylinder. In the case of FIG. 3*a*, the air impingement hood is fitted outside the wire loop, which thus allows for easy maintenance. The paper clippings, or broke, formed in connection with breaks or shutdowns of the machine falls into the pocket P formed at the drying cylinder by the dryer wire, from which it may be difficult to remove the broke before starting up the machine again.

Figure 3B:
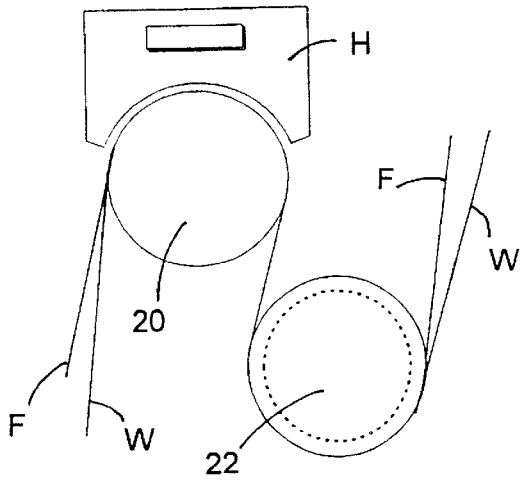

FIG. 3*b* shows a slightly different air impingement solution, in which the air impingement hood H is fitted over the drying cylinder 20 of a dryer section provided with single-wire-wire web transfer, to blow hot air through the wire F, towards the web W. In case of a web break, the broke can fall down freely under the machine. The maintenance of the hood H may, however, be difficult to arrange. Air impingement arranged in connection with a conventional drying cylinder takes place through the wire, towards the side of the web which is away from the drying cylinder. In this way, therefore, in addition to the general improvement of drying efficiency, one-sided drying of the web can also be made uniform.

Figure 3C:
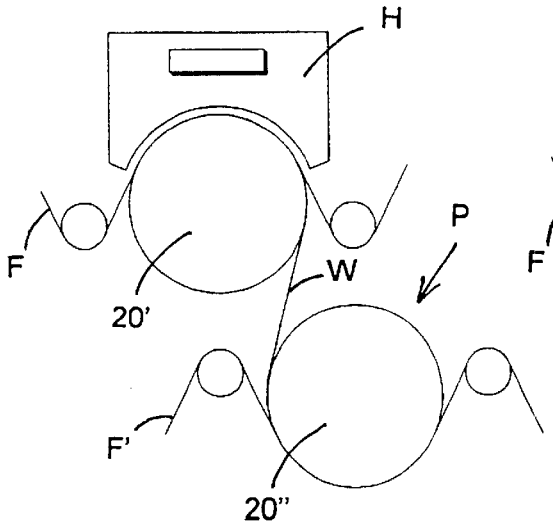
Figure 3D:
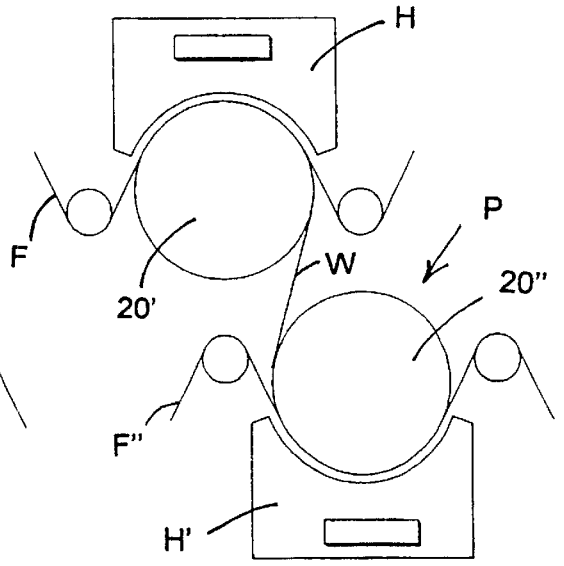

FIG. 3*c* shows a part of a dryer section provided with twin-wire web transfer, in which there are two rows of drying cylinders 20' and 20". The air impingement hood H is fitted to blow hot air through the wire F towards the web W, as shown in FIG. 3*b*. In case of a web break, the broke falls down into a pocket P formed by the lower wire F'. In the case of FIG. 3*d*, deviating from the case of FIG. 3*c*, a lower air impingement hood H' is fitted in conjunction with the lower drying cylinder 20" in addition to the upper air impingement hood H. In case of a web break, in this case also, the broke collects in the pocket P formed by the lower wire F".

In the case of FIGS. 3*b*–3*d*, hot air is blown through the wire F, F' towards that side of the web W which is away from the drying cylinder 20, 20', 20", which reduces the one-sidedness of drying and curling of the paper. The wire F, F', however, both disturbs air blowing and reduces the drying efficiency of hot air blowing. As regards energy consumption, it should be noted that blowing through the wire towards the web increases energy consumption in comparison to blowing directly onto the web. Moreover, a wire made of synthetic material limits the temperature of the hot air. In air impingement, it is then usually not possible to blow air hotter than about 300° C. Furthermore, in the cases shown in FIGS. 3*b*–3*d*, the air impingement hoods are fitted inside the wire loops, which hinders access to the hoods and thus also their maintenance.

The above-mentioned disadvantages do not occur in the air impingement modules $M_1$–$M_3$ shown in FIGS. 1*a* and 1*b*.

Figures 4, 4A:
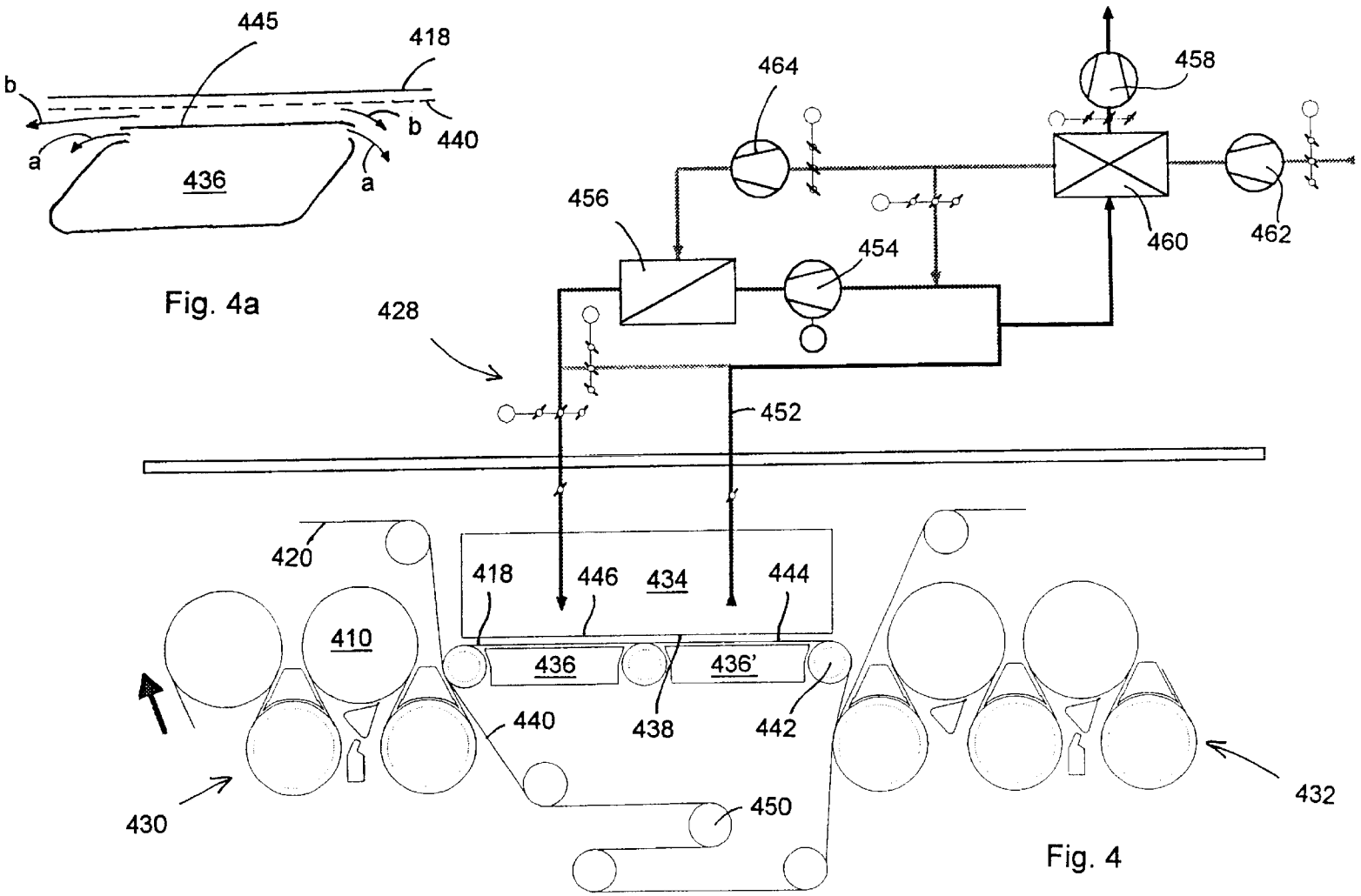
FIG. 4 shows diagrammatically a cross-section in the web direction of a linear air impingement unit applying the invention when fitted between two drying cylinder groups.
FIG. 4*a* shows diagrammatically an enlarged view of the vacuum box shown in FIG. 4.

FIG. 4 shows an air impingement unit 428 relating to a special embodiment of the invention, fitted between the drying cylinder groups 430 and 432 provided with single-wire-wire web transfer. The air impingement unit comprises a linear air impingement hood 434, which together with two linear vacuum boxes 436 and 436' fitted below the hood forms a linear slot-like space 438. The paper web 418 is arranged to pass through the slot-like space while supported on the dryer wire 440.

In this solution, the paper web is preferably fitted to pass under the air impingement unit, supported by the wire and the underpressure created by the vacuum box. The vacuum holds the web in contact with the wire. Without the support of the vacuum, hot air blowing might detach the web from the wire. To create a vacuum, it is preferable to use a vacuum box in this solution, which by means of blasts creates a vacuum that holds the web to the wire. If so desired, some other type of suction box can also be used to create a vacuum.

The wire 440 supporting the paper web passes, supported by rolls 442, for example suction rolls, above the vacuum boxes without touching them, and forms a horizontal track 444 for the web. The wire and the web thus run, supported by the rolls 442 and the vacuum boxes 436, 436', at a suitable distance from the cover of the vacuum box and the side 446 of the air impingement hood adjacent to the slot. The distance of the nozzle surface 446 of the air impingement unit adjacent to the slot from the paper web is typically about 10–50 mm, preferably 15–25 mm.

In the case shown in FIG. 4, below the dryer wire conveying the web 418, two vacuum boxes 436 complying with FIG. 4*a* are fitted inside the dryer wire loop. The vacuum boxes remove air from the space between the vacuum box 436 and the wire 440 by means of the blasts depicted by the arrows a, in the direction of arrow b, thus forming a vacuum in this space. A vacuum of typically about 100–400 Pa, preferably 200–300 Pa is formed between the wire and the cover of the box. This vacuum suffices to keep the web 418 on the wire 440 in a stable manner. The same blasts—arrows a—keep the wire at a certain distance from the boxes 436, thus preventing the wire from touching the surface structure 445 of the boxes. Suction rolls 442 or the like guide the passage of the wire 440 past the air impingement unit. Below the vacuum boxes, the passage of the wire loop is guided by means of conventional turning rolls 450.

Figure 5A:
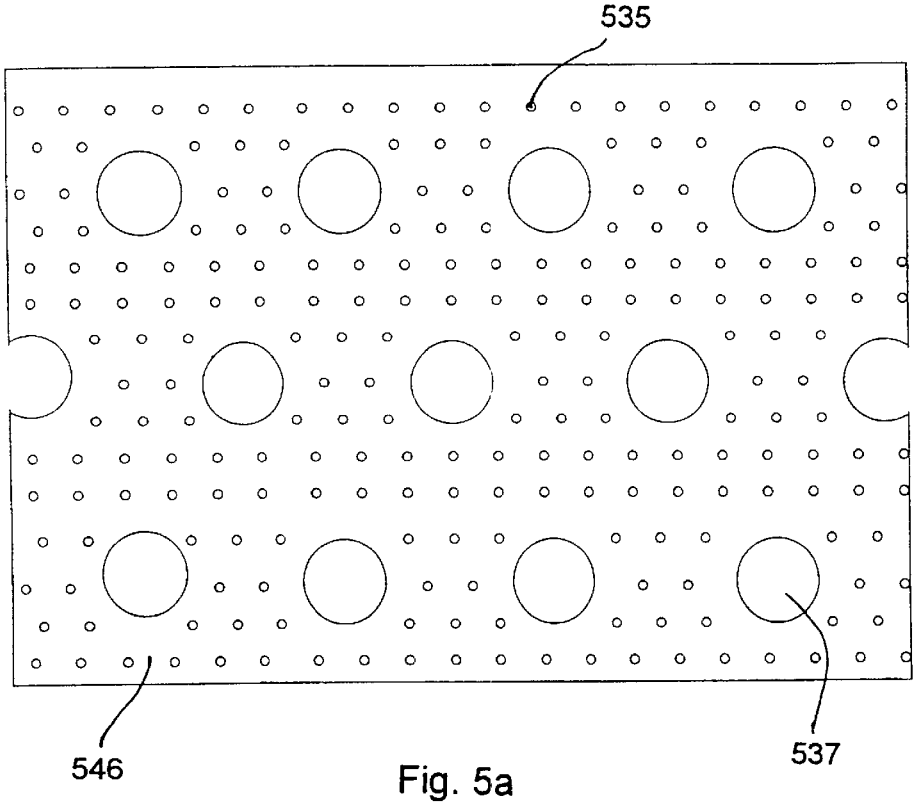
FIG. 5*a* shows diagrammatically a part of the nozzle surface of the air impingement hood shown in FIG. 4.
Figure 5B:
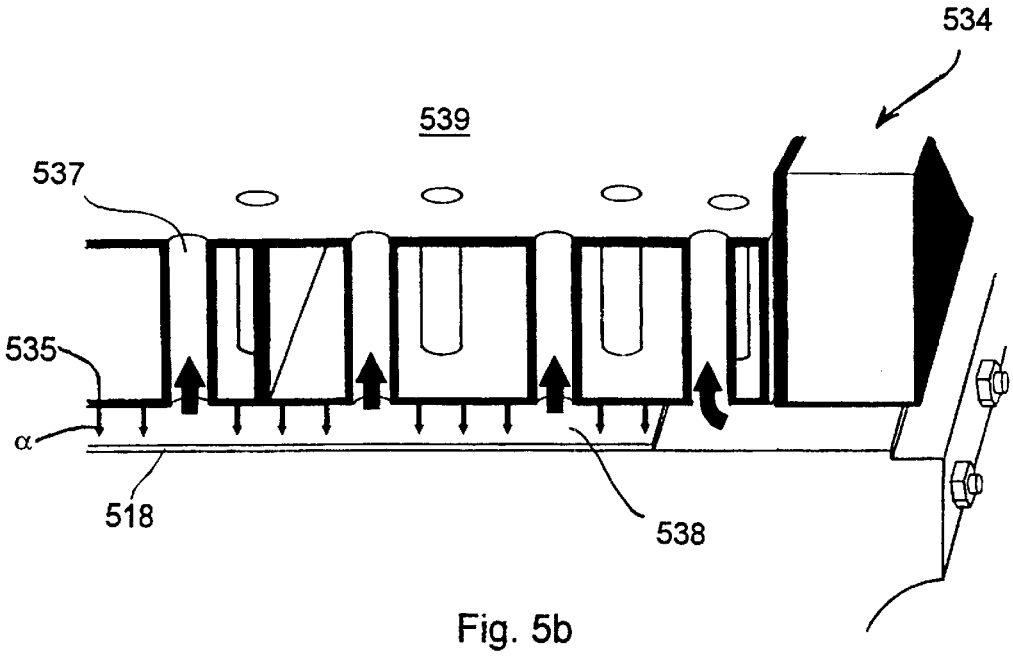
FIG. 5*b* shows diagrammatically a vertical cross-section of a part of the air impingement hood shown in FIG. 4.

The air impingement hood 434 is comprised of a casing-like structure, on whose mainly planar nozzle surface 446, which is towards the web, that is, on the side adjacent to the paper web, there are formed a large number of nozzles, such as apertures or slots, from which hot air or steam blasts are blown towards the web. A part of the nozzle surface of an air impingement hood relating to the invention is shown in FIGS. 5*a* and 5*b*. Several nozzles—in FIGS. 5*a* and 5*b* apertures 535—are preferably fitted on the nozzle surface 546 in succession, in several adjacent rows extending across the web. The open area formed by apertures 535 or slots on the nozzle surface 546 is preferably 0.5–5%, more preferably 1–2.5%, the distance between the apertures being 10–100 mm (15–35 mm).

As shown by the arrows $\alpha$ in FIG. 5*b*, the nozzles 535 blow hot air or steam, preferably approximately at right angles to the web 518, onto that side of the web which was not in contact with the hot surface of the drying cylinders in the previous dryer section 430 (FIG. 4). Thus the air impingement unit forms a part that reduces curling in the dryer section.

In the solution shown in FIG. 4, the air impingement hood's own return air is used in the hot air jets of the hood. The air returning from the web is taken from the hood 434, through the pipes 537 shown in FIGS. 5*a* and 5*b*, into the hood's collection space 539. From the collection space the return air is conducted by means of the blower 454 shown in FIG. 4, through a connecting pipe 452 to the heater 456, and from there back again to be heated and blown by the air hood 434 onto the web. Some of the humid return air is removed by means of a fan 458, through a heat exchanger 460, for keeping the air humidity suitable in the return air. New, dry blast air can be fed by means of the blowers 462, 464 through the heat exchanger 460 and the burner 456 into the return air.

In the solution shown in FIG. 4, the paper web is passed by a closed transfer from a drying cylinder group 430 operating by single-wire-wire web transfer to the wire 440 to be conveyed past the air impingement hood 434. Hot air is blown from the hood towards the web in order to achieve the desired efficient drying impulse, in order to regulate drying, to eliminate curling and/or to achieve good profiling. The drying efficiency of the air blown towards the web can be regulated by adjusting the temperature, humidity or velocity of the hot air jets blown towards the web. The temperature of the hot air can be regulated simply by, for example, adjusting the burner 456. The humidity of the hot air is correspondingly easily adjustable by discharging a greater or lesser part of the humid return air through the blower 458. The velocity of the hot air can be regulated by adjusting the blower 454. In the solution relating to the invention, the temperature of the hot air jets directed at the paper web can be regulated by several degrees in an instant, which means that the drying efficiency of the hot air jets can also be adjusted instantly so as to be higher or lower. By means of the solution relating to the invention it is, therefore, possible to regulate the drying of the paper web to the correct level in a very short time, typically in less than 30 seconds, even in less than 10 seconds, for example, after a change of grade or a sudden change taking place in the press section.

In case of a web break, the paper clippings, or broke, in the air impingement unit is easily removed from the linear section by being conveyed by the dryer wire, between the air impingement unit and the drying cylinder group 432 down to floor level, from where it can rapidly be removed. Also the air impingement unit relating to the invention, not being surrounded by a wire loop, in the pocket of which paper clippings might collect during a web break, improves the runnability of the machine. The air impingement unit can easily be lifted up and away from above the dryer wire 440 for maintenance.

The air impingement unit relating to the invention can be made very short—the length of one short air impingement hood and one vacuum box—if the aim is, for example, only to eliminate curling of the paper web or to improve profiling. For profiling, even a short intensive drying impulse—precision treatment—on the correct part of the web suffices.

Figure 6:
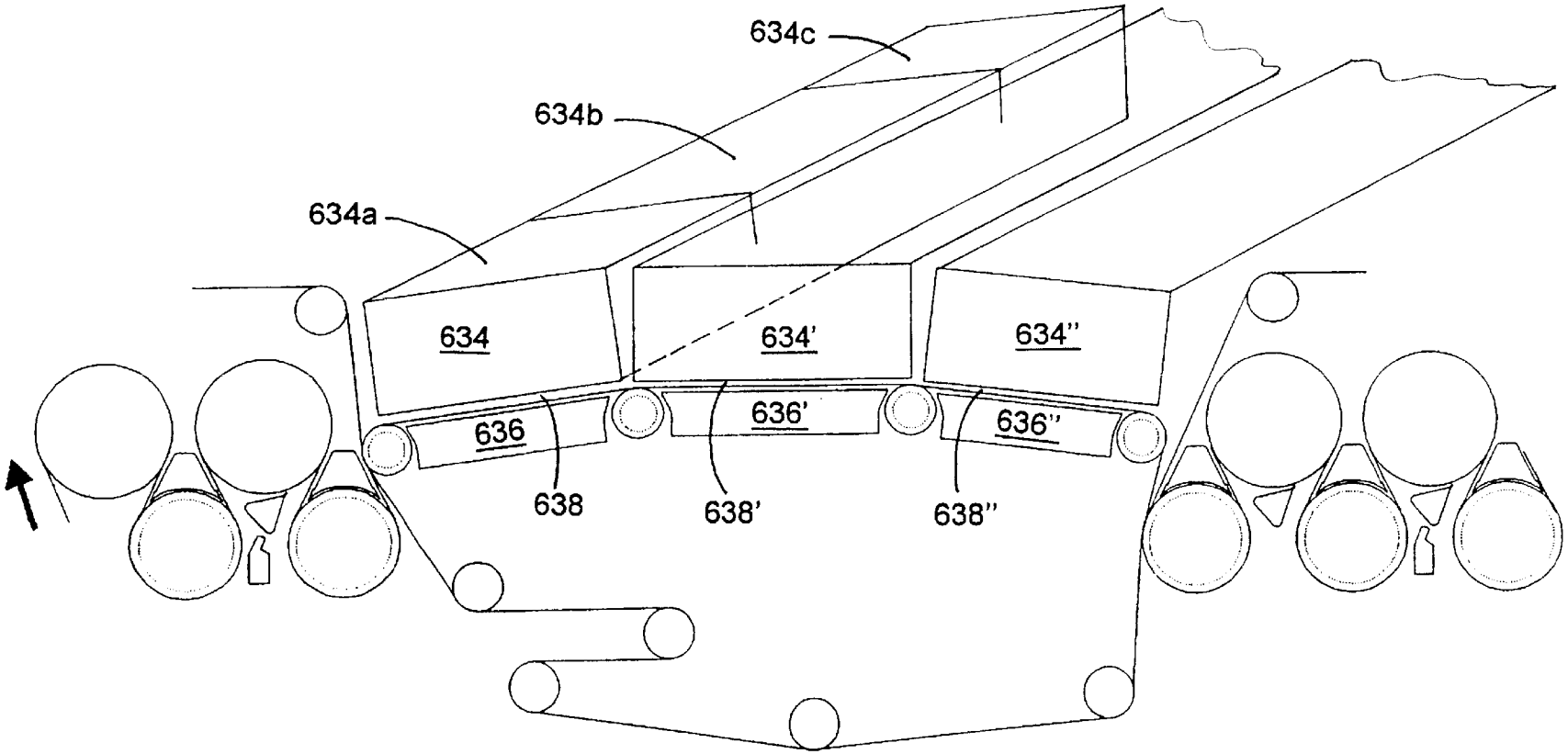
FIG. 6 shows, in the same manner as FIG. 4, a second linear air impingement unit relating to the invention.

On the other hand, the actual drying of the web can also be increased by means of the air impingement hood, in which case the air impingement unit can be made longer, if necessary. FIG. 6 shows a longer air impingement unit comprised of three air impingement hoods 634, 634', 634". Below each air impingement hood a separate vacuum box 636, 636', 636" is fitted. The air impingement hoods and vacuum boxes, which are in themselves linear and straight, are fitted in succession to form a curved slot between them, so that the first air impingement hood 634 and the vacuum box 636 form a slot 638 directed upwards in relation to the web, in the direction of travel of the web, the second hood/box pair 634' and 636' form a horizontal slot 638', and the third hood/box pair 634" and 636" form a slot 638" directed downwards. The slot forms an angle of <45° with the horizontal plane. The angles between the slots 638, 638', 638" are preferably 5–15°.

FIG. 6 is a drawing of the whole hood 634, as seen obliquely from above. On the hood is marked its division into separate parts or segments 634*a*, 634*b* and 634*c* across the web. In the solution relating to the invention, it is possible to regulate the drying efficiency of these different segments, which means that, for example, hot air can be blown at lower evaporation efficiency from the outermost segments 634*a* and 634*c*, and air with higher evaporation efficiency from segment 634*b* in the centre. The web often dries more on the edges than in the centre.

Figure 7:
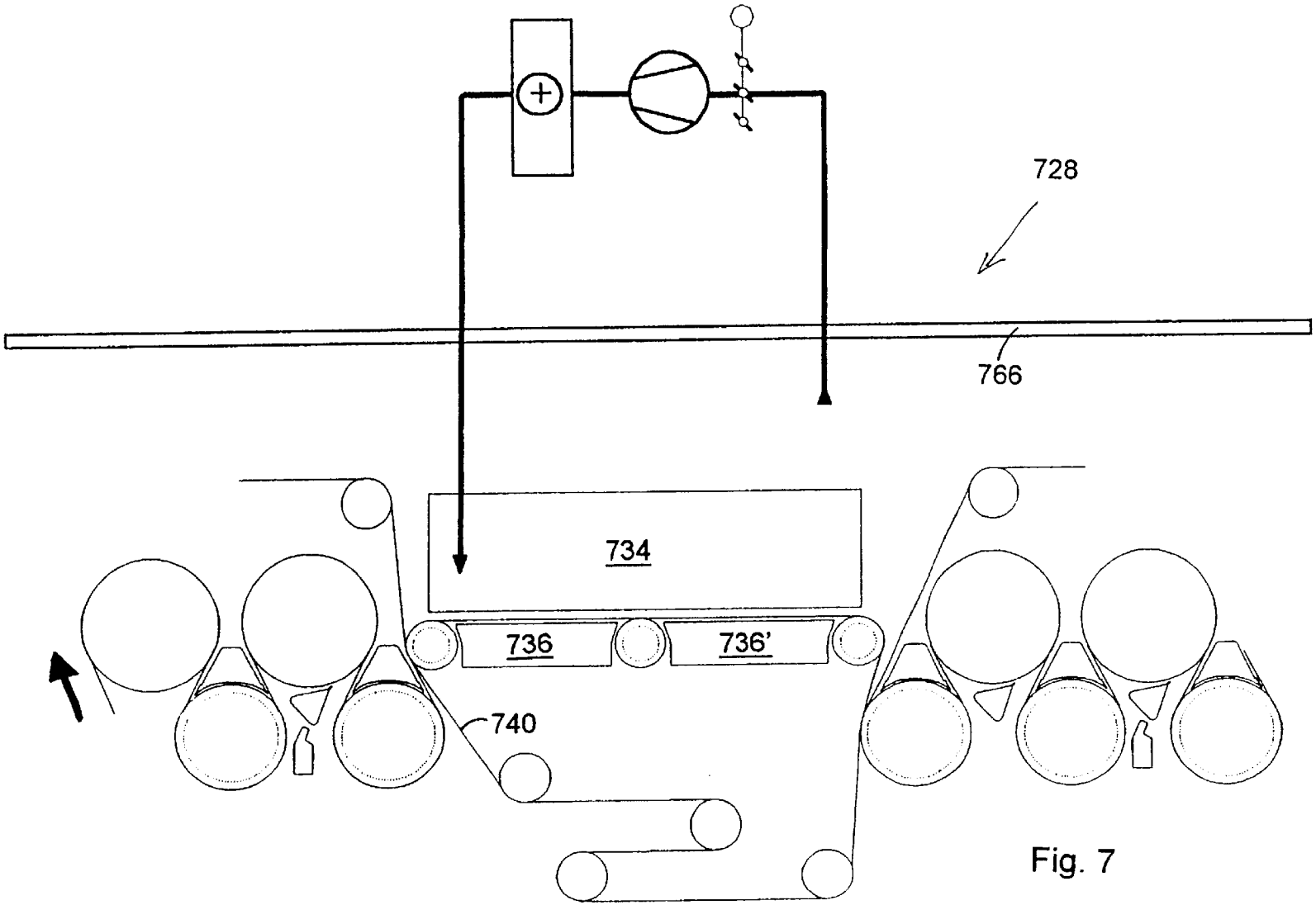
FIG. 7 shows, in the same manner as FIG. 4, a third linear air impingement unit relating to the invention.

FIG. 7 shows an air impingement unit 728 relating to FIG. 4, which, however differs from the above in that the blast air used is not return air, but instead air taken directly from under the dryer section hood 766. The used humid air is not collected from the web area, but instead the humid air is allowed to flow freely into the space under the hood.

FIG. 8 shows a typical curve of showing the variation of the drying efficiency of the drying cylinders in a conventional 68-cylinder dryer section provided with single-wire-wire web transfer. In the first part of the dryer section, at stage 1, is a so-called area of increasing evaporation, in the intermediate part of the dryer section, at stage 2, is an area of constant evaporation, and in the last part of the dryer section, at stage 3, is an area of diminishing evaporation.

At the top of FIG. 8 is shown additionally, by way of an example as regards a dryer section,

- the optimum area for air impingement, that is, the areas in the dryer section in which the web can advantageously be influenced by means of air impingement, in comparison to cylinder drying,
- the optimum area for profiling, that is, the area in the dryer section in which the profiling of the web, that is, the cross-direction drying of the web, can best be influenced,
- the optimum area for controlling curling, that is, the area in which curling due to one-sided drying of the web can best be reduced,
- the optimum area for controlling curling, in which curling can best be influenced by a drying impulse, e.g. by means of air impingement of short duration, and
- the optimum area for combined increasing of drying efficiency, profiling and curling control.

The optimum area for performing air impingement in order to affect all the foregoing regulation of drying has been found to be within the range where the paper web has already dried to a dry-matter content of >70%, but not yet 95%, preferably within the range where the paper web has already dried to a dry-matter content of >75%, but not yet 85%. The optimum area for air impingement often falls within a range where the web has a dry-matter content of approximately 75%–80%. In the dryer section provided with single-wire-wire web transfer shown in FIG. 5, which comprises almost 70 drying cylinders, this optimum area falls approximately between the 48th and the 61st drying cylinder.

Figure 9:
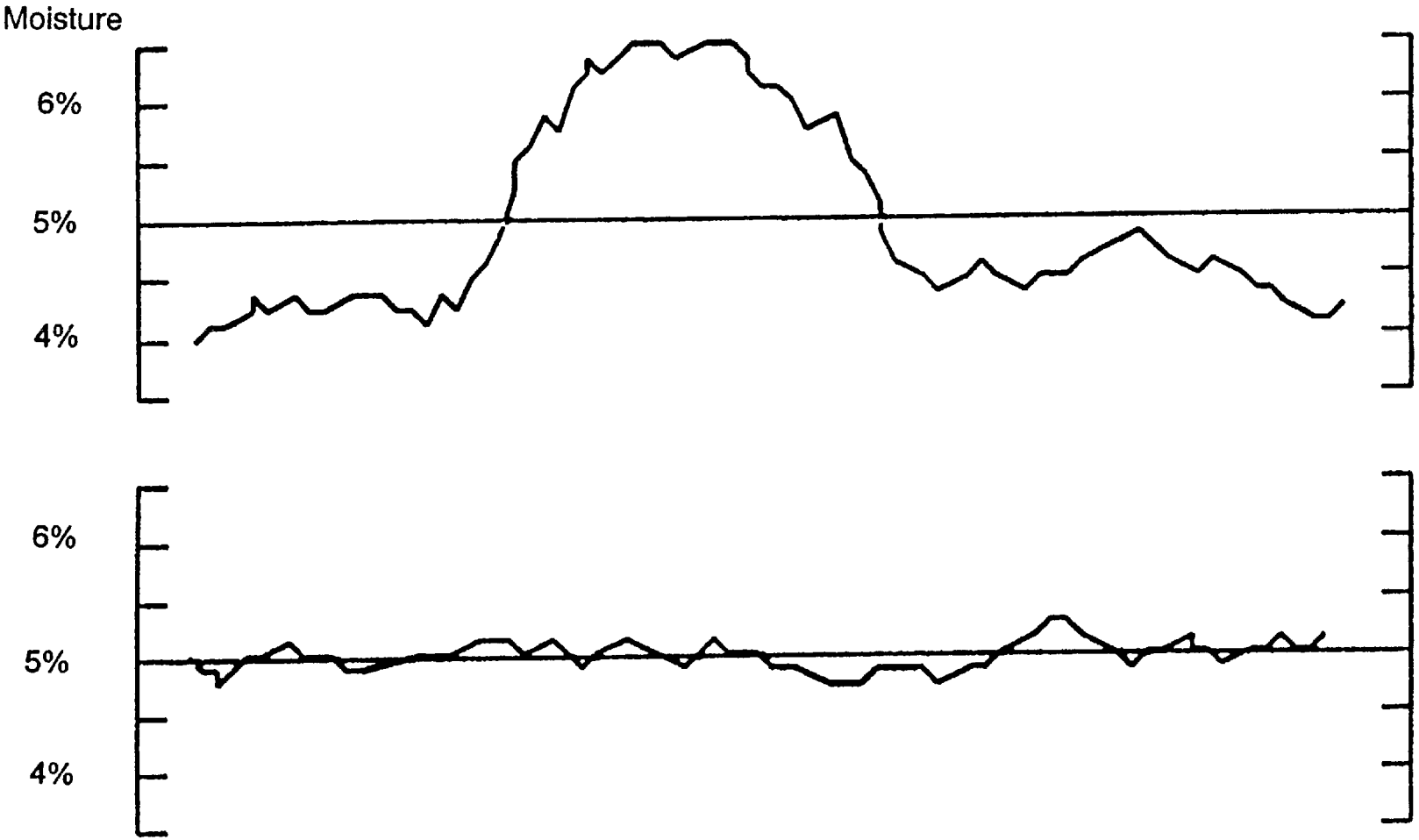
FIG. 9 shows the moisture profile curve of the paper web before and after profiling with the apparatus relating to the invention.

FIG. 9 shows an example of the profiling of a printing paper web according to a solution relating to the invention. The upper curve in the figure shows the moisture profile, without separate profiling, of the paper web coming from the dryer section which incorporates a 5 m long air impingement unit in addition to the drying cylinders. The average moisture content of the paper web is 5.3%, that of the edge areas 4.1% and that of the central area 6.5%, while the temperature of the air impingement air is approximately 300° C. and velocity a constant 80 m/s across the entire web.

The profiling of the paper web is done by closing the outermost segments of the air impingement unit and by increasing the blowing velocity of the middle segment to 150 m/s. In this way, the average moisture level remains almost the same, that is, at 5.1%, the moisture level of the edges increases and that of the middle part decreases. The moisture values vary between 4.7 and 5.4. The web's moisture profile has thus become markedly more uniform, as can be seen from the lower curve in FIG. 6.

The primary purpose of the linear air impingement unit relating to the special embodiment of the invention is not necessarily to remove moisture from the web in a conventional manner. Since the evaporation efficiency of the air impingement dryer can be changed very rapidly, the drying efficiency of the dryer section as a whole can be regulated more rapidly than in conventional cylinder drying, although there may only be one dryer relating to the invention in the machine. This may be utilised advantageously in a change of grade, where with conventional device solutions, there often occur even relatively long periods during which the dry matter content "creeps" before reaching a stable status. By means of a rapidly reacting air impingement unit these phenomena can be reduced decisively and even completely eliminated.

The fact that, due to the rapid regulation, the shut-down and start-up of the machine can be accomplished faster may be considered a notable advantage of the solution relating to the invention. The structure of the air impingement unit also contributes to improving the runnability of the machine because, for example, the removal of broke in the area of the unit is easily performed.

The air impingement unit is suitable for use in controlling the curling of the web when the drying energy is brought through that surface of the web which has not been in contact with the preceding drying cylinders. The linear air impingement unit can also be fitted in a manner differing from the solutions shown in FIGS. 2–4, so that the slot through which the web passes is vertical, if this is desirable for reasons of use of space or other reasons.

The air impingement units, which are relatively small in size, can easily be fitted in an existing dryer section to improve the operation of the dryer section, moisture content control, curling and profiling. The air impingement units can easily be divided into separate segments, which make it possible to use the unit for regulating the moisture profile in the cross direction of the web.

The invention is described in the foregoing with reference to only some of its advantageous embodiments, to the details of which the invention is not, however, intended to be strictly limited. Many modifications and variants are possible within the scope of the inventive idea specified in the claims presented below.

What is claimed is:

1. A method of drying a paper web using a plurality of heated drying cylinders, and at least one air impingement module having a hood for blowing a blowing medium directly against the paper web, comprising:

(a) bringing the paper web into operative contact with the heated drying cylinders; and (b) regulating at least one of final moisture content, quality, and cross-direction profile of the paper web by adjusting an efficiency of air impingement drying of the paper web by adjusting at least one of a blowing velocity of a medium blown directly against the paper web, a humidity of the blowing medium, a temperature of the blowing medium, and a distance of the hood of the at least one air impingement module from the paper web.

2. A method as recited in claim 1 wherein b) is practiced to regulate every one of the final moisture content, quality, and cross-direction profile of the paper web by adjusting every one of the blowing velocity of the medium blown against the paper web, the humidity of the blowing medium, the temperature of the blowing medium, and the distance of the hood of the at least one air impingement unit from the paper web.

3. A method as recited in claim 1 wherein the drying cylinders are in a plurality of groups; and further comprising (c) also regulating at least one of final moisture content of the paper web and its quality by adjusting a steam pressure of one or more drying cylinder groups.

4. A method as recited in claim 1 further comprising (c) measuring the final moisture content of the paper web after substantially a last drying cylinder, and (d) utilizing the measurement from (c) to adjust the efficiency of the air impingement drying in (b).

5. A method as recited in claim 3 further comprising measuring the final moisture content of the paper web after the last drying cylinder group, and adjusting the steam pressure of one or more drying cylinder groups in response to that measurement to thereby regulate the final moisture content of the paper web.

6. A method as recited in claim 4 wherein (b) is practiced to regulate properties of the paper web across the entire width thereof.

7. A method as recited in claim 3 wherein at least one of (b) and (c) are practiced by regulation on the basis of model predictive multi-variable control.

8. A method as recited in claim 3 wherein at least one of (b) and (c) are practiced by regulation based on an optimization algorithm which optimizes at least one of quality and production costs of the paper web.

9. A method as recited in claim 1 wherein (b) is practiced by at least one of adjusting machine-direction segments of the air impingement hood separately, and by closing machine-direction segments of the air impingement hood.

10. A method as recited in claim 1 further comprising (c) effecting a change of paper web grade, and (d) during the change of paper web grade, regulating the drying efficiency by at least one of (i) using information on the paper web grade or models describing the change of paper web grade to control the steam pressures of the drying cylinders, (ii) by controlling one or more air impingement modules of the at least one air impingement module on the basis of a target value, and (iii) by using continuous feedback control from a measuring device which measures final moisture content downstream of a last drying cylinder.

11. A method as recited in claim 1 further comprising: (c) during start-up of the method, preheating the drying cylinders and the air impingement hoods of the at least one air impingement module; setting running parameters of the web by controlling air impingement from the module and by adjusting a steam pressure of the drying cylinders on the basis of feedback from a measurement of final moisture content of the web downstream of a last drying cylinder; and regulating air impingement as a drying efficiency of the drying cylinders changes.

12. A method as recited in clam 1 further comprising: (c) during a break of the paper web switching steam pressures of the drying cylinders and efficiencies of the at least one air impingement module to break values; and (d) after the break is repaired or remedied, switching the steam pressures of the drying cylinders and the efficiency of the least one air impingement module back to normal running values, and correcting the paper web quality by adjusting air impingement parameters.

13. A method of treating a paper web in a paper machine having a press section and a drying section, the drying section including at least one drying cylinder group, and a wire passing through a slot-like space formed between the curved or linear air impingement hood and a curved or linear surface, said method comprising:

(a) passing the paper web from the press section through at least one drying cylinder group;

(b) drying the paper web in the at least one drying cylinder group to an average dry matter content of greater than 70%; and (c) guiding the paper web from the at least one drying cylinder group supported on a wire through the slot-like space formed between the air impingement'hood and surface, and blowing several successive air or steam jets directly against the web in the slot-like space in the cross-web direction in order to regulate the dry matter content of the paper web.

14. A method as recited in claim 13 further comprising (d) after the dryer section or drying cylinder group, measuring the dry matter content of the paper web; and wherein (c) is practiced to regulate the dry matter content of the paper web by adjusting the drying efficiency of the air or steam jets according to the measurements from (d).

15. A method as recited in claim 14 wherein at least two successive air impingement hoods are provided extending across the web; and wherein (c) is practiced by separately adjusting the drying efficiency of the air or steam jets coming from each air impingement hood.

16. A method as recited in claim 13 using at least two air or steam jet groups in a cross-web direction; and wherein (c) is practiced to regulate the dry matter content of the paper web in the cross-web direction by at least one of separately adjusting the drying efficiencies of the at least two air or steam jet groups in succession in the cross-section direction, and separately adjusting the drying efficiency of each air jet in succession in the cross-web direction.

17. A method as recited in claim 13 wherein (c) is practiced by blowing air jets toward the paper web, and regulating the drying efficiency of the air jets by adjusting the temperature of the air jets between about 200–400° C.

18. A method as recited in claim 13 wherein (c) is practiced by blowing air jets toward the paper web, and by regulating the dry matter content of the paper web by adjusting the drying efficiency of the air jets by adjusting the moisture content so that it varies between about 0–300 $gH_2O$/kg of dry air.

19. A method as recited in claim 13 wherein (c) is practiced by blowing air jets toward the paper web, and by regulating the dry matter content of the paper web by adjusting the drying efficiency of the air jets by adjusting the velocity of the air jets within the range of about 50–150 meters per second.

20. A method as recited in claim 13 wherein (c) is practiced by blowing air jets toward the paper web and using as the source of air at least one of replacement air from the paper machine room, return air of a hood and a dryer section closed by a hood, and return air from the impingement drying; and further comprising at least one of increasing the temperature, and decreasing the moisture level, of the air before blowing it toward the paper web.

21. A method as recited in claim 13 wherein two or more air impingement hoods or air impingement hood sections are utilized; and further comprising: (d) blowing return air from the two or more air impingement hoods or air impingement hood segments, toward the paper web; and further comprising heating the return air before it is directed to the air impingement hoods or segments in at least one of a common area for all of the air impingement hoods or segments, and a separate area for each air impingement hood or segment.

22. A method as recited in claim 13 wherein (c) is practiced so that the average dry matter content of the paper is increased to within the range of 75–95%.

23. A method as recited in claim 13 wherein (c) is practiced utilizing two or more successive air impingement hoods, and wherein (c) is practiced so that the drying efficiency of the air jets from the first air impingement hood is on average higher than the drying efficiency of air jets from the following air impingement hoods.

24. A dryer section of a paper machine for drying a paper web, comprising:

a plurality of drying cylinders for operatively engaging the paper web;

at least one air impingement module, having an air impingement hood, for blowing a fluid medium directly against the paper web;

a measuring device which measures the final moisture content of the paper web passing through the dryer section; and means for adjusting at least one of the blowing velocity, temperature, and humidity of the fluid medium, and the distance of the air hood from the paper web.

25. A dryer section as recited in claim 24 further comprising means for regulating the steam pressure of said drying cylinders.

26. A dryer section as recited in claim 24 further comprising at least one control unit for regulating the efficiency of said at least one air impingement module in response to the measurements from said measuring device.

27. A dryer section as recited in claim 26 wherein said plurality of drying cylinders are in groups including a first group which operatively engages a highest moisture content portion paper web, and a last group which operatively engages a lowest moisture content portion of the paper web; and wherein said measuring device is located downstream of said last drying cylinder group.

28. A dryer section as recited in claim 27 further comprising means for regulating the steam pressure of the drying cylinders of one or more of said drying cylinder groups.

29. A dryer section as recited in claim 26 further comprising a memory operatively connected to said at least one control unit for regulating drying efficiency and supplying paper grade-specific information to said control unit.

30. A dryer section as recited in claim 24 further comprising means for measuring at least one of any quality of the paper web, and the cross-direction profile of the paper web; and means for measuring the blowing efficiency of at least one of said at least one air impingement module, and the cross-direction profile of said at least one air impingement module.

31. Apparatus for optimizing at least one of the drying of a paper web in a paper machine, and the power consumption in the dryer section of the paper machine, comprising:

at least one first drying cylinder group which dries a paper web to an average dry matter content of greater than 70%;

at least one air impingement module which further controls drying of the paper web after exiting said at least one first drying cylinder group; and said at least one air impingement module comprising: an air impingement hood extending across at least the paper web; a curved or linear counter-surface extending across at least the paper web, and defining with said hood a slot-like space therebetween through which the paper web can pass; and means for blowing several air or steam jets directly against the paper web as it passes through said slot-like space.

32. Apparatus as recited in claim 31 wherein said curved or linear countersurface comprises a suction roll or a vacuum box.

33. Apparatus as recited in claim 31 further comprising a last drying cylinder group; and wherein said at least one air impingement module is located between said at least one first drying cylinder group and said last drying cylinder group.

34. Apparatus as recited in claim 31 further comprising a last drying cylinder group; and wherein said at least one air impingement module is located substantially immediately after said last drying cylinder group.

35. Apparatus as recited in claim 31 wherein said at least one air impingement module comprises two or three successive air impingement hoods in the direction of paper travel, and two or three suction rolls or vacuum boxes defining said curved or linear counter-surface in the direction of travel of said paper web; and wherein said hoods and counter-surfaces define a substantially horizontal slot-like space between them.

36. Apparatus as recited in claim 31 wherein at least one air impingement module comprises an air impingement hood cooperating with two or three vacuum boxes in succession in the direction of travel of the paper web, said vacuum boxes positioned below said air impingement hood to form a substantially horizontal slot-like space therebetween.

37. Apparatus as recited in claim 31 further comprising a wire extending through said slot-like space to facilitate transport of a paper web therethrough; and further comprising means for creating a vacuum beneath said wire.

38. Apparatus as recited in claim 31 further comprising an endless wire loop for supporting the paper web in said slot-like space; and wherein said counter-surface is mounted within said endless wire loop.

39. Apparatus as recited in claim 31 further comprising an endless wire loop for transporting the paper web through said slot-like space; and a plurality of turning rolls for supporting the paper web in said slot-like space.

40. Apparatus as recited in claim 31 wherein said at least one air impingement module comprises a linear dryer section; and further comprising at least one drying cylinder group following said linear dryer section; and a closed paper web transfer from said first drying cylinder group to said linear dryer section, and from said linear dryer section to said last drying cylinder group.

41. Apparatus as recited in claim 31 wherein said at least one impingement module comprises two or more air impingement hoods, or air impingement hood sections; and further comprising a common means for at least one of heating return air directed toward said two or more air impingement hoods or segments, and reducing the humidity of return air directed to said two or more air impingement hoods or segments.

42. Apparatus as recited in claim 31 wherein said at least one impingement module comprises two or more air impingement hoods or air impingement hood segments; and further comprising integrated means within each of said air impingement hoods or segments for at least one of heating return air and reducing the humidity of return air received by said air impingement hoods or sections.

43. Apparatus as recited in claim 31 wherein said air impingement hood comprises two or more rows of aperture or slit nozzles extending across the paper web for blowing air or stream jets toward the paper web.

44. Apparatus as recited in claim 43 wherein said aperture or slit nozzles are formed in a substantially planar perforated or slotted plate forming the bottom of the air impingement hood and substantially parallel to the paper web; and wherein said perforated or slotted plate is adjacent to said slot-like space, and wherein the open area of said perforated or slotted plate is between about 1–2.5%, and the distance between apertures is between about 15–35 mm.

45. Apparatus as recited in claim 31 wherein said at least one air impingement module comprises a linear dryer section having a length of about 5–10 meters.

46. Apparatus as recited in claim 31 wherein said at least one impingement module comprises a linear dryer section; and wherein said linear dryer section is positioned in an inclined or vertical position so that the paper web will pass through said slot-like space in a plane deviating from the horizontal.

* * * * *

UNITED STATES PATENT AND TRADEMARK OFFICE

CERTIFICATE OF CORRECTION

PATENT NO. : 6,365,004 B1
DATED : April 2, 2002
INVENTOR(S) : Hamstrom et al.

It is certified that error appears in the above-identified patent and that said Letters Patent is hereby corrected as shown below:

Title page,
Item [75], reads "[75] Kristian Hamstrŏm, Turku; Harri Happonen, Tampere; Antti Kuhasalo, Jyväskylä; Juha Lipponen, Palokka; Järkko Nurmi, Turku; Juha Ojanen, Valkeakoski; Hans Sundqvist, Turku, all of (FI)." should be
-- [75] Kristian Hamström, Turku; Harri Happonen, Tampere; Antti Kuhasalo, Jyväskylä; Juha Lipponen, Palokka; Jarkko Nurmi, Turku; Juha Ojanen, Valkeakoski; Hans Sundqvist, Turku, all of (FI). --

Signed and Sealed this

Sixth Day of May, 2003

JAMES E. ROGAN
*Director of the United States Patent and Trademark Office*